United States Patent [19]

McKinney

[11] Patent Number: 4,848,598

[45] Date of Patent: Jul. 18, 1989

[54] DISPENSING DEVICE

[75] Inventor: James C. McKinney, Somerset, N.J.

[73] Assignee: Colgate-Palmolive Company, Piscataway, N.J.

[21] Appl. No.: 161,551

[22] Filed: Feb. 29, 1988

[51] Int. Cl.[4] ..... B67D 5/42

[52] U.S. Cl. ..... 222/391; 222/326; 74/128; 92/29

[58] Field of Search ..... 222/391, 340, 509, 336, 222/94; 74/148, 155, 133, 128; 604/224, 208, 209; 92/29

[56] References Cited

U.S. PATENT DOCUMENTS

| | | | |
|---|---|---|---|
| 742,912 | 11/1903 | Schwechler | 222/32.6 |
| 766,861 | 8/1910 | Rubly | 222/32.6 |
| 1,114,832 | 10/1914 | Whitney | 74/148 |
| 2,582,156 | 11/1952 | Peterson | 222/391 |
| 2,604,858 | 7/1952 | Bosa | 222/391 |
| 3,174,657 | 3/1965 | Sandholm | 222/32.6 |
| 3,884,396 | 5/1975 | Gordon et al. | 222/391 |
| 4,461,403 | 7/1984 | Prahs | 222/391 |

FOREIGN PATENT DOCUMENTS

| | | | |
|---|---|---|---|
| 86/02724 | 5/1986 | World Int. Prop. O. | 222/391 |

*Primary Examiner*—Joseph J. Rolla
*Assistant Examiner*—Kenneth Noland
*Attorney, Agent, or Firm*—Richard J. Ancel; Robert C. Sullivan; Murray M. Grill

[57] ABSTRACT

A dispensing device of the hand-help pump type has an internal piston which is pulled up by a rod passing through the piston, which rod is moved by an actuator. When the contents of the piston are emptied, in order to attach a refill, a dog release mechanism operates to release the dogs which, in normal use when the device is full, function to prevent the piston from being drawn downwardly so that the piston can be removed to allow attachment of the refill which has a new piston.

11 Claims, 3 Drawing Sheets

DISPENSING DEVICE

FIELD OF THE INVENTION

Hand-held pumps for pasty material such as toothpaste which have internal pistons which are drawn upu by a rod which is normally prevented from downward movement by tangs or dogs connected to the piston.

BACKGROUND

In recent years, dispensing devices for a wide range of pasty and viscous substances such as toothpaste, food product such as cheese, creams and other materials have come into wide use. Especially popular are hand-held pumps which provide attractive, easy-to-use containers for use by consumers both at home and while travelling.

In particular, hand-held pumps for dentifrice materials such as toothpaste and gels (hereinafter referred to for convenience collectively as "pastes") have gained considerable consumer acceptance. They have become an alternative to tubes, but tubes are currently substantially less expensive than paste pumps now on the market.

Since pumps have properties many consumers prefer over tubes, it is believed that if a pump could be designed for manufacture at a cost equal to or less than tubes, sales of such a pump would increase substantially.

Pumps adapted for dispensing paste are generally found in International Classes G01F 11/00 and B67D 5/32 and in Class 222 in the U.S. Patent and Trademark Office. Representative thereof are the following U.S. Pat. Nos. issued in recent years: 4,511,068; 4,598,843; 4,437,591; and 4,657,161.

Although there are several types of pumps for pasty materials now on the market, there are none which are refillable. That is, when the pump contents are emptied, the entire pump must be discarded since there is no means by which the pump can be refilled. This is expensive, because the internal parts of the pump and the pump body are relatively expensive and if they could be saved through the use of a refill having a new supply of toothpaste or other pasty material, the consumer would benefit greatly, i.e., instead of having to pay for a new pump in addition to the product—which is what the consumer actually desires to purchase—the consumer could simply buy a relatively inexpensive refill containing the product and attach it to the pump, thereby saving the cost of purchasing a new pump mechanism.

One widely used type of hand-held pump utilizes an actuator mechanism which requires the application of pressure thereon by the user to draw up a notched rod which passes through the piston. The piston has connected to it a series of tangs, known as "dogs" which engage the notches as the piston is drawn up by the actuator so as to prevent the piston from thereafter moving downwardly. Another variation employs a smooth rod wherein the dogs press against the rod with sufficient force to prevent downward movement of the piston. Dogs of this type thus make it impossible to remove the piston by withdrawing it down the rod. Consequently, since the piston must be removed in order to attach a refill with a new piston at its bottom—where the piston must be in draw-up type pumps, the existing inability to remove the original piston has prevented the development of a refill system for this type of pump. Since, as indicated, it would be highly desirable to provide a refillable pump, this technical problem is a primary problem which the art has not been able to overcome until the present invention.

SUMMARY

The present invention provides a novel means for releasing piston dogs whereby the piston can be easily removed after the contents of the pump are emptied, so that a refill having a new piston can be easily fitted to the original pump mechanism.

Thus, it is a primary object of the present invention to provide a piston dog release mechanism.

It is a further object of this invention to provide a refillable dispensing device having a piston which is drawn up by a notched or smooth rod and controlled against downward movement by dogs to provide means whereby the dogs are released when the piston is at the top of the device which occurs when the contents are emptied so that the piston can be removed and a refill can be attached to the device.

It is another object to provide a device for dispensing paste which is refillable by removing the original piston and attaching a refill.

Another object of the invention is to provide a refill for a dispensing device which includes a piston.

These and other objects of the invention will become apparent from the following detailed description, drawings and the claims.

THE DRAWINGS

DETAILED DESCRIPTION

Figure 1:
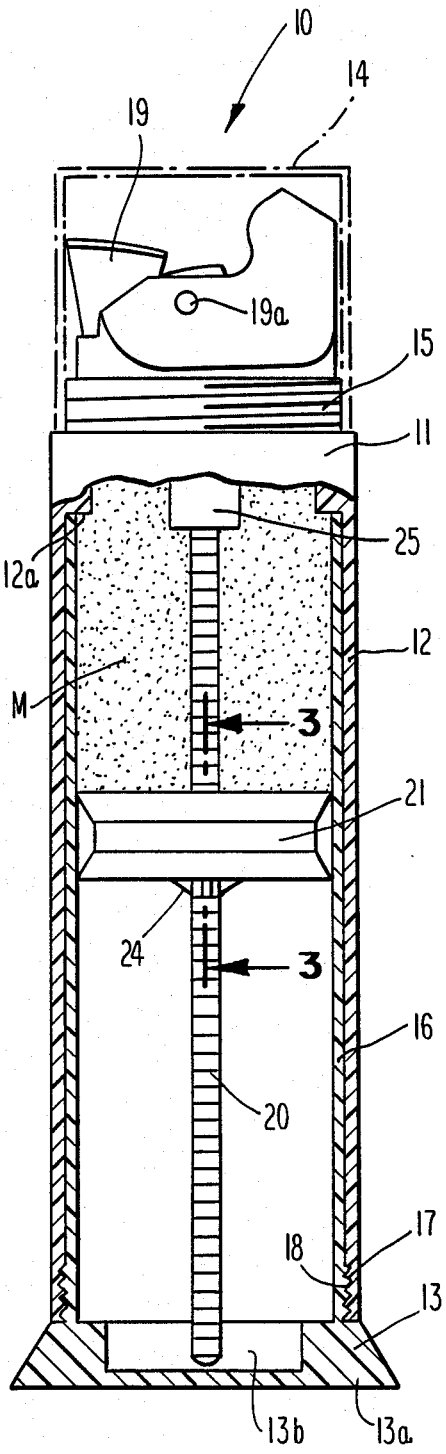
FIG. 1 is an elevational view, partly in section, showing one preferred embodiment of the dispensing device of the present invention including a refill which has been partially emptied.

FIG. 1 shows a preferred embodiment of the dispensing device of this invention in the form of a hand-held pump for toothpaste or other pasty substances M and is generally designated 10.

Pump 10 has a outer body 11, preferably cylindrical as shown, which has a body wall 12. Fitted within body 11 is a refill 13 having a base 13*a* and side walls 16 which terminate at their upper end flush against shoulder 12*a* of body wall 12 of the basic pump 11. Refill 13 is secured to body 11 by screw threads 17 on refill 13 which engage matching threads 18 on body wall 12 whereby the refill can be removed.

Pump 10 has a cap 14 which is removed by unscrewing the same from threads 15 formed at the top of pump 10. When the cap 14 is removed for use, there is exposed an actuator 19 which, by using thumb or finger pressure, moves down. In turn, actuator 19 is attached to a pivot 19*a* and the part of the actuator extending beyond the pivot 19 functions as a lever to pull up rod 20. (The specific lever mechanism is not shown herein but can be of the type disclosed in U.S. Pat. No. 4,437,591, especially in FIG. 2.)

Rod 20 passes through a body rod support 25 and thence through a hole in a collar 40 which is centrally mounted in a hole in piston 21 and terminates in a well 13*b* formed in base 13.

Figure 2:
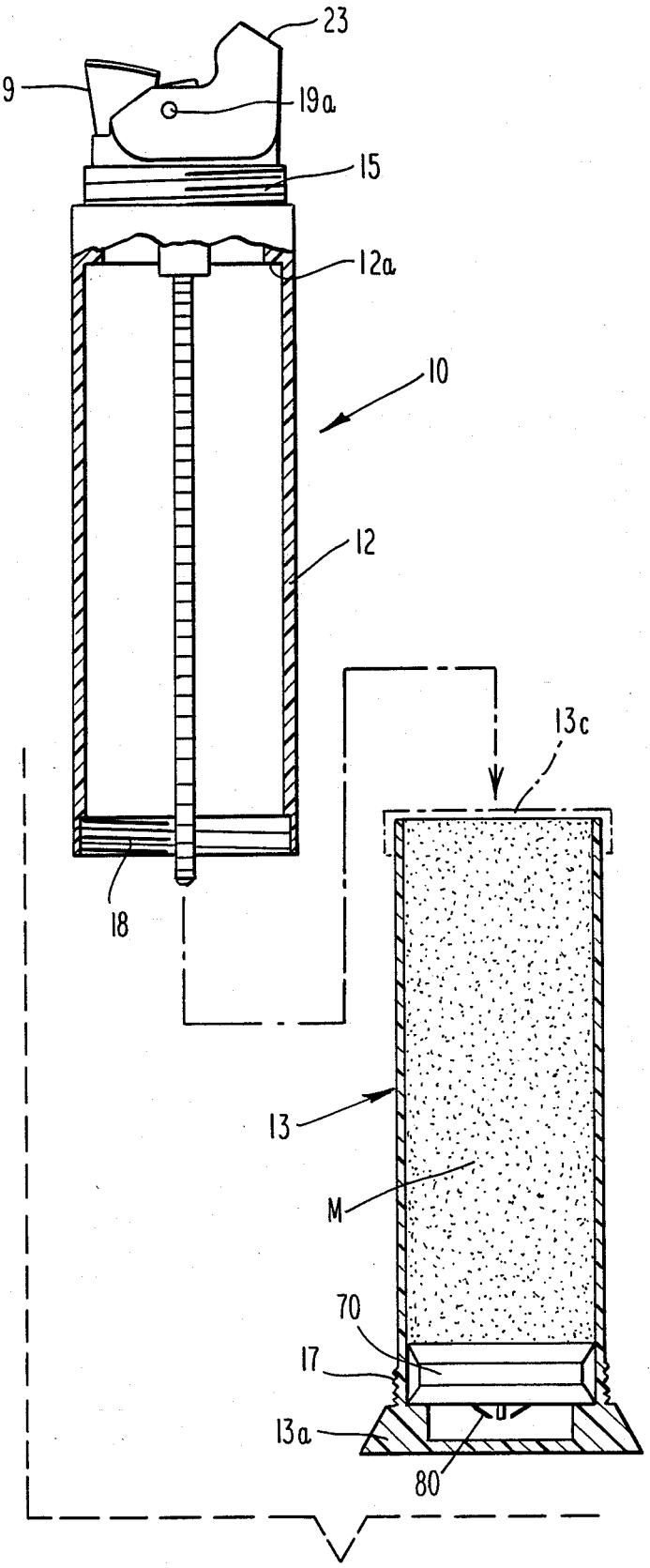
FIG. 2 shows on the left the basic pump mechanism of the dispensing device shown in FIG. 1 and, on the right, a refill container for such device fully loaded with product. The devices of FIG. 2 are elevational sectional views, except the basic pump mechanism head is shown in perspective.
Figure 3:
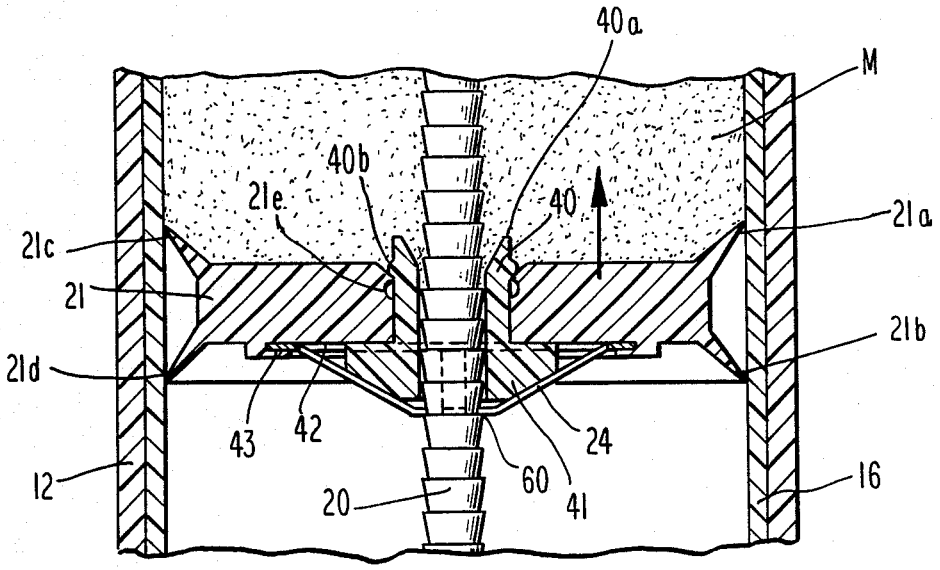
FIG. 3 is a sectional view taken along the lines 3—3 of FIG. 1 showing the dogs engaging the piston rod to prevent downward movement of the piston.
Figure 4:
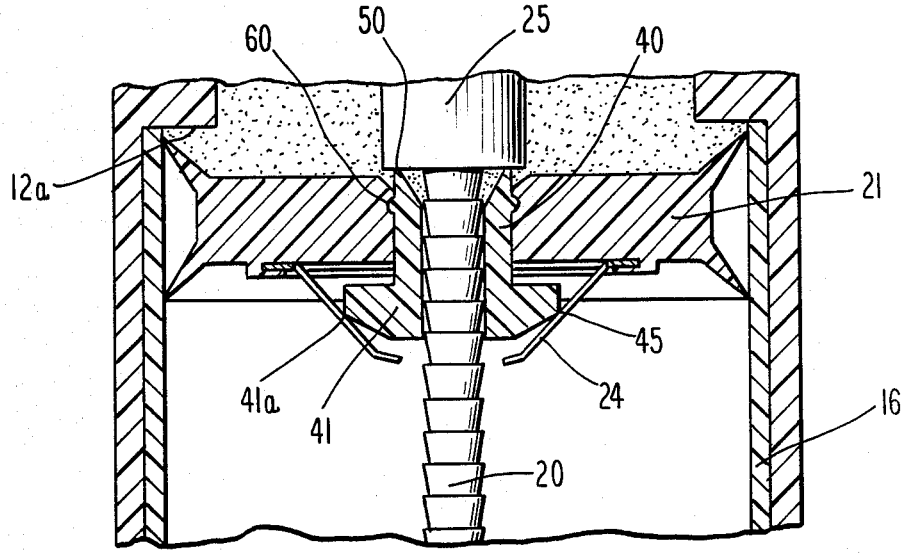
FIG. 4 is a sectional view similar to FIG. 3 showing the piston at the top of its travel and the dogs released.

It will be observed that in the embodiment of FIGS. 1–4 the rod 20 is notched. Turning to FIGS. 3 and 4, the piston 21 has flange-like seals 21*a*–21*d* which slidably bear against the interior wall 16 of refill 13 to prevent paste M from flowing down past the piston.

Piston 21 is attached to central collar 40 which has an upper flared end 50. Collar 40 has a dog stop 41 beneath piston 21. Piston 21 has a slot 43 on its lower surface which holds a dog plate 42 to which there are attached a series of flexible dogs 24 which are usually spring metal tabs. The dogs 24 engage the notch of rod 20 in the position shown in FIG. 3 at 60. Since the notches are frusto-conical, the larger diameter is in the upward end of the rod and forms a lip which prevents the dogs from moving down while, at the same time, allowing the dogs to move up when the actuator 19 pulls the rod up. In fact, because they bear against the lips of rod 20, the dogs 24 must move up with the rod 20 and push up against dog stop 41 which, in turn, pushes up against plate 42 and piston 21, thereby to move piston 21 up which forces paste M out of nozzle 23.

In FIGS. 1 and 3, paste M has been partially emptied. However, FIG. 4 shows the assembly when the paste M has been emptied: piston 21 has risen to the top of insert 16 and the flared upper end 40*a* of collar 40 has come into abutting position with rod support 25. In prior art devices, the dogs 24 would continue to prevent the downward movement of piston 21 because they would remain in engagement with the notches on rod 20.

However, dog stop 41 of the present invention has a unique extension 41*a*. Since dog stop 41 is an integral part of collar 40, and because collar 40 is movably downwardly through the hole in piston 21 through which it passes from the normal "up" position shown in FIG. 3 to the "down" position shown in FIG. 4 when its upper end 40*a* engages rod support 25, the latter engagement pushes collar 40 down so that it comes down through the opening in piston 21 at which point a protusion 40*b* on collar 40 locks into an annulus 21*e* formed in the surrounding wall of piston 21.

The downward movement of collar 40 serves to move dog stop 41 down also. This movement continues until collar 40 and piston 21 are locked together at 60. At this position, the extension 41*a* of dog stop 41 moves dogs 24 away from rod 20, as shown in FIG. 4, thereby releasing the dogs 24 from the notches in the rod 20.

When the above removal is completed, the "basic" pump, i.e., the pump components shown in FIG. 1 minus the piston 21, collar 40 and dog stop 41, is ready to be refilled. It will be understood that, when the contents of the refill shown in FIG. 1 are emptied, refill 13 is detached before piston 21 and the other afore-mentioned components are removed. When those components are removed, a new refill, like that shown in the right of FIG. 2, is screwed into the basic pump. It will be observed that the new refill has a new piston 70 disposed at its bottom which has the same components, i.e., a collar, dog stop and dog plate, as piston 21 shown in FIGS. 3 and 4, including new dogs 80.As indicated by the dot-dash lines in FIG. 2, the refill 13 is inserted into the pump 10 shown on the left in FIG. 2 so that rod 20 passes through the opening in new piston 70, at which point the refill 13 is screwed onto the basic pump whereupon the dogs 80 engage rod 20 so that use of actuator 19 pulls rod 20 up to force paste M out of the pump nozzle 23.

Figure 5:
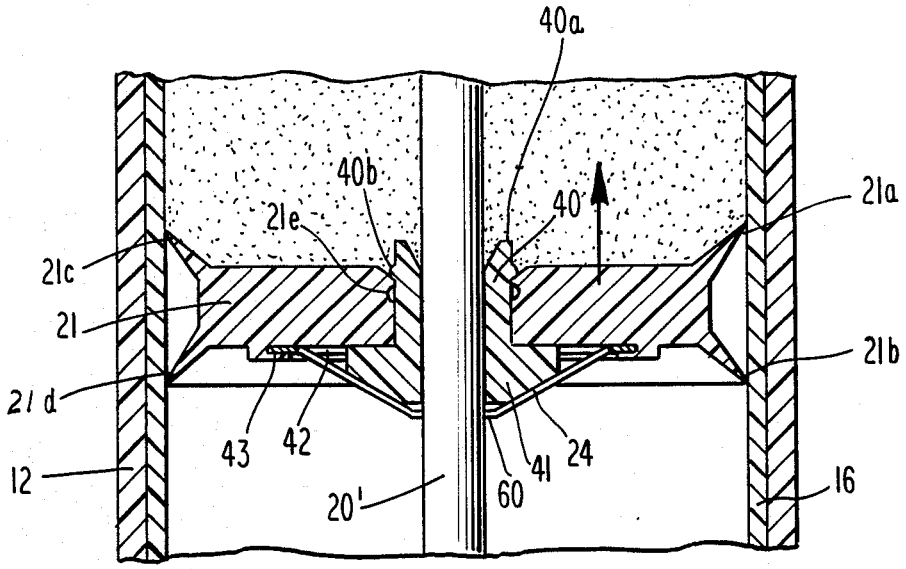
FIG. 5 is a sectional view similar to FIG. 3 illustrating another embodiment of the invention employing a smooth piston rod and showing the dogs engaging the piston rod to prevent downward movement of the piston.
Figure 6:
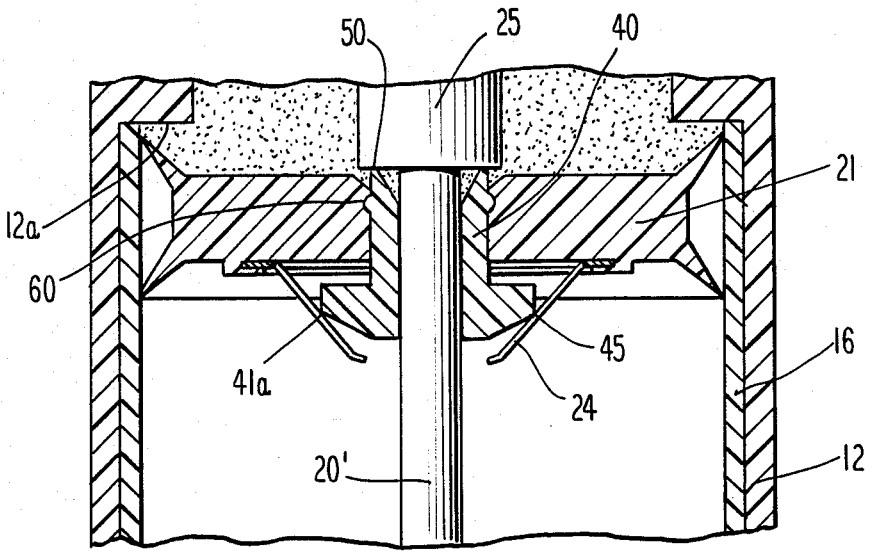
FIG. 6 is a sectional view similar to FIG. 4 illustrating the embodiment of FIG. 5 showing the piston at the top of its travel and the dogs released.

As indicated, it is within the scope of this invention to employ a smooth (i.e., non-notched) piston rod but using the other pump components described and illustrated in FIGS. 1–4. A preferred embodiment of such a smooth rod device is illustrated in FIGS. 5 and 6. It will be understood that the other parts of the pump shown in FIGS. 1–4 are the same and, therefore, like numbers refer to like parts in FIGS. 5 and 6.

In FIG. 5, the smooth rod 20' is held firmly in place by dogs 24 pressing against it. In FIG. 6, the piston has risen to the top, and dog stop 41*a* has moved dogs 24 away from engagement with smooth rod 20', thereby releasing the dogs 24 from contact with rod 20'. At this time, piston 21, collar 40 and dog stop 41 may be pulled down rod 20' and removed from rod 20'. Thus, the device can be refilled in the manner described in connection with the embodiment of FIGS. 1–4.

Refill 13 normally will be sold with a cover 13*c* of a suitable material such as foil to protect its contents from leakage or spoilage.

Accordingly, it will be evident from the foregoing that the unique design of the present device makes it possible to produce refillable pumps and that substantial benefits exist for consumers because, once they have purchased one pump, they can thereafter retain the basic pump and simply buy relatively inexpensive refills.

The refill 13 may be made of any suitable material including metal or plastic. Plastics such as polypropylene (PP), polyethylene (PE) and copolymers thereof, polyethylene terepthalate (PET) may be used for the refill, especially when the refill is a single layer structure. It is also possible to provide refills having multilayer structures produced by coextrusion, including layers having gas barrier properties. Ethylene vinyl alcohol (EVOH), polyamides (PA) such as nylon and polyvinylidene chloride (PC) are materials which provide good gas barrier properties which is important for certain products, such as paste, where it is desirable to prevent the loss of certain components of the contents which can enter the gas phase and permeate through the materials of non-gas barrier structures.

I claim:

1. A dispensing device having a body, a head attached to the body, a piston, a rod passing through the piston, actuator means for pulling the piston up toward the head, flexible means for engaging the rod to prevent the piston from downward movement when the device has contents remaining in it, and means for moving the flexible means out of engagement when the piston reaches its uppermost point of travel, said means for moving the flexible means comprising said body having an internal shoulder neat its upper end, and said moving means further comprises said piston surrounding a collar, said collar disposed for movement in the piston in a downward direction when said collar engages said internal shoulder to release the flexible means from the rod.

2. The invention of claim 1 wherein said collar includes a dog stop which has an extension which pushes said flexible means away from the rod when the collar engages said shoulder.

3. The invention of any one of said claims 1 or 2 wherein the dispenser is adapted to receive a refill.

4. A refill in combination with claim 4 wherein the refill comprises a refillable dispensing means comprising a closed bottom and integral side walls and open top end and having disposed therein a piston with an opening therein for reception of the rod.

5. The invention of claim 4 wherein the piston has connected to it flexible means for engaging said rod to prevent the piston from moving in a down direction during normal use.

6. The invention of claim 5 wherein the piston surrounds a movable collar having dog means and wherein the collar is operable to move down in the piston to move the dog means down so that the latter move the flexible means out of engagment with the rod.

7. The invention of claim 4 wherein the refill is made of material including polymers selected from the group consisting of PE, PP, copolymers of PP and PE and PET.

8. The invention of claim 4 wherein the refill is made at least in part of multilayer material wherein at least one layer is a gas barrier material.

9. The invention of claim 8 wherein the gas barrier material is selected from the group consisting of EVOH, PA and PC.

10. The invention of any one of claims 1 or 2 and 5–9 wherein the rod is notched.

11. The invention of any one of claims 1 or 2 and 5–9 wherein the rod is smooth.

* * * * *